US008672520B2

(12) United States Patent
Morkel

(10) Patent No.: US 8,672,520 B2
(45) Date of Patent: Mar. 18, 2014

(54) AC VOLTAGE REFLECTOR LAMP

(75) Inventor: Matthias Morkel, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 220 days.

(21) Appl. No.: 12/864,243

(22) PCT Filed: Jan. 25, 2008

(86) PCT No.: PCT/EP2008/050878

§ 371 (c)(1),
(2), (4) Date: Jul. 23, 2010

(87) PCT Pub. No.: WO2009/092451

PCT Pub. Date: Jul. 30, 2009

(65) Prior Publication Data

US 2010/0296295 A1 Nov. 25, 2010

(51) Int. Cl.
*F21V 7/08* (2006.01)

(52) U.S. Cl.
USPC ..... 362/304; 362/297

(58) Field of Classification Search
USPC ..... 362/517–519, 304, 297, 346; 359/858
See application file for complete search history.

(56) References Cited

U.S. PATENT DOCUMENTS

| | | | | | |
|---|---|---|---|---|---|
| 3,914,593 | A * | 10/1975 | Laribe | 362/517 |
| 4,218,727 | A * | 8/1980 | Shemitz et al. | 362/297 |
| 4,408,266 | A * | 10/1983 | Sclippa | 362/297 |
| 5,367,446 | A | 11/1994 | Ellion | |
| 5,556,191 | A | 9/1996 | Maassen | |
| 5,902,033 | A * | 5/1999 | Levis et al. | 353/122 |
| 6,431,736 | B1 * | 8/2002 | Saladin | 362/516 |
| 6,635,012 | B2 * | 10/2003 | Ayame et al. | 600/178 |
| 2001/0040806 | A1 * | 11/2001 | Okazaki | 362/296 |
| 2004/0032739 | A1 * | 2/2004 | Johanson | 362/304 |
| 2005/0062384 | A1 | 3/2005 | Guy | |
| 2006/0083006 | A1 | 4/2006 | Poel | |
| 2006/0203497 | A1 | 9/2006 | Shimaoka et al. | |
| 2010/0182790 | A1 * | 7/2010 | Montagne | 362/296.05 |

FOREIGN PATENT DOCUMENTS

| | | | |
|---|---|---|---|
| EP | 1635379 | A1 | 3/2006 |
| JP | 2001160304 | A2 | 6/2001 |
| JP | 2002237202 | A2 | 8/2002 |

OTHER PUBLICATIONS

English Abstract for JP 2001 160304 A2.
English Abstract for JP 2002 237202 A2.
International Search Report of PCT/EP2008/050878 dated Oct. 15, 2008.

* cited by examiner

*Primary Examiner* — Nimeshkumar Patel
*Assistant Examiner* — Christopher Raabe

(57) ABSTRACT

A lamp with an AC lamp burner may include two electrodes spaced apart from one another, a device configured to apply a voltage with alternating polarity to the electrodes; and a reflector, which has a first partial section, which is in the form of a partial body of a first ellipsoid, which has a first and a second focus, or is in the form of a partial body of a first paraboloid, which has a first focus, the reflector having a second partial section, which is in the form of a partial body of a second ellipsoid, which likewise has a first and a second focus or is in the form of a partial body of a second paraboloid, which has a first focus, the first foci of the two ellipsoids or paraboloids being located at different points.

6 Claims, 1 Drawing Sheet

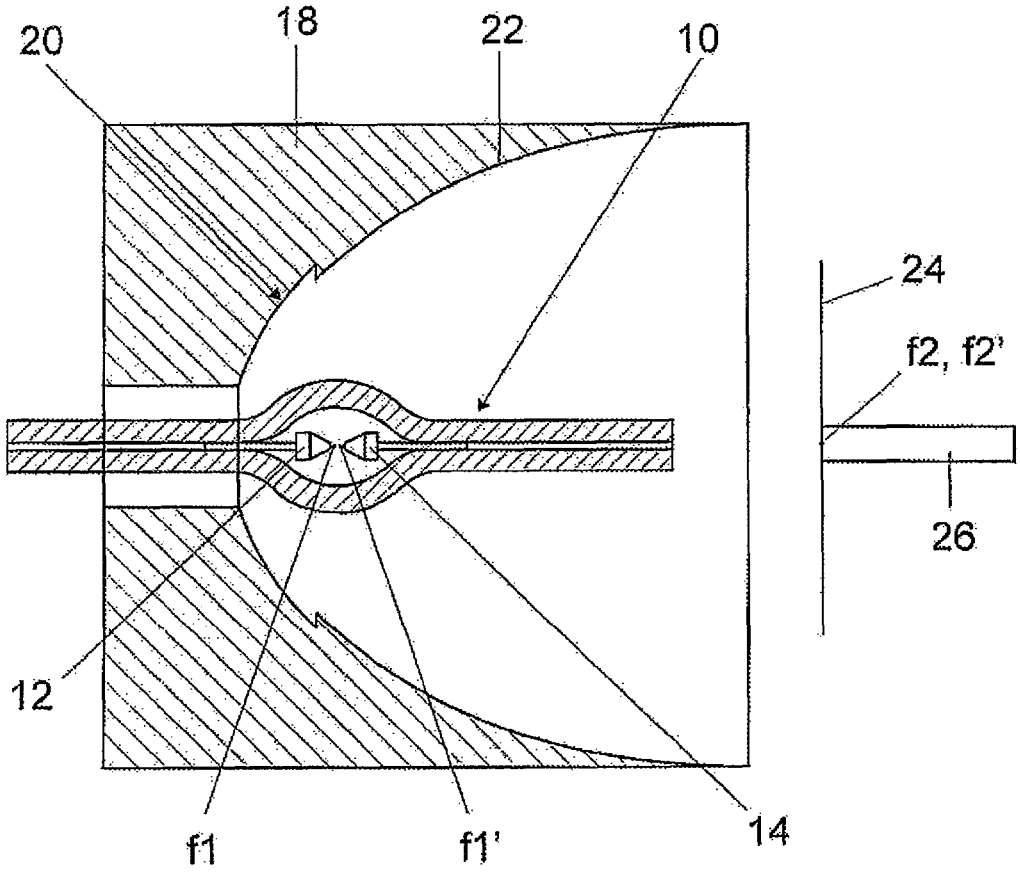
20
18
22
10
24
f2, f2'
26
12
f1
f1'
14

AC VOLTAGE REFLECTOR LAMP

RELATED APPLICATIONS

The present application is a national stage entry according to 35 U.S.C. §371 of PCT application No.: PCT/EP2008/050878 filed on Jan. 25, 2008.

TECHNICAL FIELD

Various embodiments relate to a lamp. Various embodiments concern a so-called AC lamp, i.e. a lamp operated on an AC voltage. Such lamps are generally discharge lamps. Two electrodes of the burner of the lamps are spaced apart from one another. A voltage with alternating polarity is applied to said electrodes. The light generated by the burner is collected by a reflector and sent in a predetermined direction. Generally, elliptical reflectors, i.e. reflectors which are partial bodies of an ellipsoid, are used in AC reflector lamps. As is known, an ellipsoid has two foci. It is endeavored to position the burner in the reflector in such a way that the first focus is the point with the greatest luminance. The other focus in the ellipsoid is the point to which the light is sent, and this can be apertur of the lamp or an entry into a fiberoptic conductor, with which the light is guided to a remote application.

In some applications, parabolic reflectors can also be used. The parabolic reflector is a borderline case of the elliptical reflector with the numerical eccentricity $\epsilon=1$. The light emerges from the reflector parallel, and is therefore not focused.

BACKGROUND

Two-stage reflectors are known from JP 2001 160304 A2 and JP 2002 237202 A2. This configuration is intended in this case to take into consideration a certain emission characteristic.

The utilized flux achieved is not optimal with the lamps of the type mentioned at the outset. It would be desirable for in particular an improved form of the reflector to be proposed. In particular, it is desirable to avoid a situation in which the light is guided once again by the burner bulb since, in this case, undesirable absorption effects by the electrodes or scattering effects by the bulb wall can occur, which can firstly lead to premature lamp failure and secondly can have application disadvantages.

SUMMARY

Various embodiments develop a lamp in such a way that the utilized flux is increased.

According to the invention, a reflector is therefore used which includes at least two different partial sections, namely the two partial sections are in the form of partial bodies of ellipsoids, which do have a first and a second focus, and specifically the first foci of the two ellipsoids are intended to be positioned at different points between the two electrodes.

The invention is based on the knowledge that, in the event of a change in the polarity of the voltage applied to the burner of the AC reflector lamp, the luminance centroid changes. That is to say that the luminance centroid is found ever closer to the cathode tip. Secondly, the angular distribution of the outgoing radiation also changes, to be precise the majority of the beam tends to be directed in the direction of the respective cathode. In the event of a change in the polarity (so-called commutation), the emission response therefore changes, and the reflector used according to the invention takes this into account. The focus of the first partial section can be positioned closer to the first electrode and the focus of the second partial section can be positioned closer to the second electrode, and therefore, as well as owing to the different emission characteristic, the first partial section is used for focusing a large proportion of the outgoing radiation if the first electrode is connected as cathode and the second partial section is used for focusing a large proportion of the outgoing radiation if the second electrode is connected as cathode.

Generally, the light in a lamp is intended to be focused at a specific point (aperture or optical waveguide entry), and it is then expedient if the second foci of the two electrodes coincide with one another, in which case the light is guided to the same point in the case of both polarities of the voltage.

Although it is possible in principle for the two ellipsoids to have the same numerical eccentricity, with the numerical eccentricity being the rated distance between the foci and the center of the respective ellipsoid and therefore being a dimensionless variable, the two ellipsoids preferably have a different numerical eccentricity.

The two partial sections of the reflector can be separated from one another by a single step, with the step preferably being positioned at the point where the greatest luminous flux is achieved. It is also possible to provide other partial sections in addition to the two partial sections.

In order to avoid shading losses owing to a transition edge thus provided, a smooth transition between the two partial sections can also be provided. This means that foci are provided between the first foci of the two partial sections by virtue of a transition region between the two partial sections, with infinitesimal sections of the transition region therefore being parts of ellipsoids with a first focus, which is positioned between the two first foci.

One aspect of the invention also consists merely in providing the two-part reflector which has the above-described property of the first foci of two partial sections in the form of partial ellipsoid bodies being separate from one another, with preferably even the second foci of the two ellipsoids coinciding with one another and the ellipsoids having a different numerical eccentricity.

The invention can also be used in the case of lamps with parallel light emission. In this case, ellipsoids can be replaced by paraboloids. That which has been mentioned in relation to the second focus would then of course not be applicable.

BRIEF DESCRIPTION OF THE DRAWING

The invention will be explained in more detail below with reference to an exemplary embodiment. In the drawing:

FIG. 1 shows a schematic illustration of a section through those components of a luminaire according to the invention which are essential for the description of the invention.

DETAILED DESCRIPTION

The following detailed description refers to the accompanying drawings that show, by way of illustration, specific details and embodiments in which the invention may be practiced.

A lamp includes a burner denoted by 10, i.e. the core of a discharge lamp, said burner having a first electrode 12 and a second electrode 14, which are spaced apart from one another. An AC voltage is applied to the electrodes 12 and 14 via suitable means. The discharge centroid is in each case positioned closer to the electrode 12 or 14 which is connected as cathode. Therefore, the luminance centroid of the emitted light also changes and at the same time the angular distribution of the outgoing radiation is changed. A reflector denoted by 18 belongs to the lamp. Said reflector has a first partial section 20 and a second partial section 22. The first partial section 20 is a partial body of an ellipsoid, whose first focus $f_1$ is illustrated in the FIGURE. The second partial section 22 of the reflector 18 is a partial body of a second ellipsoid, whose first focus $f_1'$ is likewise illustrated in the FIGURE. The foci $f_1$ and $f_1'$ are separate from one another, to be precise the focus $f_1$ is positioned closer to the electrode 12 and the focus $f_1'$ is positioned closer to the electrode 14. If the electrode 12 is now connected as cathode, the luminance centroid is in the region of the focus $f_1$ of the first partial section 20, and the light also tends to be emitted in the direction towards the first partial section 20 than towards the second partial section 22. The first partial section 20 is therefore particularly suitable for focusing the light emitted by the burner 10 when the electrode 12 is connected as cathode. If the electrode 14 is now connected as cathode, the luminance centroid is positioned closer to said electrode than if the electrode 12 is connected as cathode, namely in particular in the region of the focus $f_1'$ of the second partial section 22 of the reflector 18. The light also tends to be emitted in the direction towards the electrode 14, with the result that the second partial section 22 is particularly suitable for focusing the light emitted by the burner 10 when the electrode 14 is connected as cathode. In the present case, the two ellipsoids, of which the partial sections 20 and 22 are partial bodies, have the same second focus $f_2=f_2'$. This focus is positioned precisely in an aperture 24 or else in the region of entry of a fiberoptic conductor 26. The ratio of the numerical eccentricity of the ellipsoid which is defined with respect to the first partial section to the numerical eccentricity of the ellipsoid which is defined with respect to the second partial section is intended to be between 0.85 and 1.15; roughly speaking the numerical eccentricities should therefore deviate from one another by at most 15%. In the case of the two ellipsoids, the ratio between the two focal distances with respect to which the foci $f_1$ and $f_2$ (or $f_1'$ and $f_2'$) are defined should be between 0.85 and 1.15.

The provision of the reflector 18 takes account of the fact that, during commutation, i.e. when the polarity of electrodes is reversed, the luminance centroids change and the angular distribution of the outgoing radiation is changed. The utilized flux passing to the second focus $f_2=f_2'$, i.e. the utilized flux exiting through the aperture 24 or entering the fiberoptic conductor 26, is increased in comparison with conventional luminaires.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lamp with an AC lamp burner, the lamp comprising:

two electrodes spaced apart from one another;

a device configured to apply voltage with alternating polarity to the electrodes, wherein a first luminous centroid is associated with a first of said alternating polarities and a second luminous centroid different from said first luminous centroid is associated with a second of said alternating polarities; and a reflector comprising:

a first hemi-ellipsoid section of a first ellipsoid, the first ellipsoid having a first focus and a second focus, the first focus of the first ellipsoid being located at the focus of the first hemi-ellipsoid section; a second hemi-ellipsoid section of a second ellipsoid, the second ellipsoid having a first focus and a second focus, the first focus of the second ellipsoid being located at the focus of the second hemi-ellipsoid section, wherein the first foci of the two ellipsoids are located at different points respectively corresponding to the first and second luminous centroids; and wherein the second foci of the two ellipsoids coincide with one another.

2. The lamp as claimed in claim 1, wherein the two ellipsoids have a different numerical eccentricity.

3. The lamp as claimed in claim 1 wherein the two hemi-ellipsoid sections of the reflector are separated from one another by a step.

4. The lamp as claimed in claim 1, wherein a transition region between the two hemi-ellipsoid sections, with foci being provided between the first foci of the two partial sections by the transition region.

5. The lamp as claimed in claim 1, wherein the different points are positioned between the two electrodes.

6. The lamp as claimed in claim 2, wherein the first and second ellipsoids have a different numerical eccentricity, with the ratio of the two numerical eccentricities to one another being between 0.85 and 1.15.

* * * * *